US009803399B2

(12) United States Patent
Benning et al.

(10) Patent No.: US 9,803,399 B2
(45) Date of Patent: Oct. 31, 2017

(54) THERMOPLASTIC SECURITY SEAL WITH COVERED LOCKING RECESS

(71) Applicant: E.J. Brooks Company, Angola, IN (US)

(72) Inventors: Christopher Benning, Greenhithe (GB); Samuil Blonden, Plymouth (GB)

(73) Assignee: E.J. Brooks Company, Angola, IN (US)

( * ) Notice: Subject to any disclaimer, the term of this patent is extended or adjusted under 35 U.S.C. 154(b) by 0 days.

(21) Appl. No.: 14/672,387

(22) Filed: Mar. 30, 2015

(65) Prior Publication Data

US 2015/0308159 A1 Oct. 29, 2015

Related U.S. Application Data

(60) Provisional application No. 61/978,303, filed on Apr. 11, 2014.

(51) Int. Cl.
*B65D 27/30* (2006.01)
*B65D 33/34* (2006.01)
(Continued)

(52) U.S. Cl.
CPC ..... *E05B 73/00* (2013.01); *E05B 67/00* (2013.01); *E05B 67/003* (2013.01);
(Continued)

(58) Field of Classification Search
CPC ..... E05B 73/00; E05B 39/02; E05B 67/00; E05B 67/006; E05B 73/0029;
(Continued)

(56) References Cited

U.S. PATENT DOCUMENTS 968,665 A * 8/1910 Humphrey ..... G09F 3/0352 292/307 R
3,401,434 A * 9/1968 Daddona, Jr. ..... A44B 17/0029 24/689
(Continued)

FOREIGN PATENT DOCUMENTS

DE 10314940 10/2004

OTHER PUBLICATIONS

International Search Report and Written Opinion for corresponding PCT Application No. PCT/US2015/022191.

*Primary Examiner* — Carlos Lugo
*Assistant Examiner* — Faria Ahmad
(74) *Attorney, Agent, or Firm* — Gardner, Linn, Burkhart & Flory, LLP

(57) ABSTRACT

A security seal includes a molded one piece body and a cover disc. The body has a cylindrical chamber for receiving the disc. A locking recess is formed in the body in communication with the chamber and defined in part by a locking shoulder. The cover is secured to the body in the chamber to enclose the locking recess. The disc is separated from the body when enclosing the chamber. A rotatable arm is attached to an extension member extending from the body via a hinge. The free end of the arm has an arrow shaped locking element attached that engages the recess locking shoulder when inserted into the recess. The locking element has a resilient tang member that is compressed by the locking shoulder and which tang member returns to its acquiescent state when fully inserted into the recess thereby locking the tang member in the recess. The cover has posts that extend through mating bores in the body, the protruding ends of the posts are deformed to preclude withdrawal of the posts from the bores to thereby lock the cover to the body.

20 Claims, 5 Drawing Sheets

(51) Int. Cl.

| | |
|---|---|
| ***B65D 55/06*** | (2006.01) |
| ***B65D 51/00*** | (2006.01) |
| ***G09F 3/03*** | (2006.01) |
| ***E05B 67/00*** | (2006.01) |
| ***E05B 73/00*** | (2006.01) |
| ***E05C 19/08*** | (2006.01) |
| *E05B 67/06* | (2006.01) |
| *E05B 67/38* | (2006.01) |

(52) U.S. Cl.
CPC ..... *E05B 67/006* (2013.01); *E05B 73/0029* (2013.01); *E05C 19/08* (2013.01); *G09F 3/0347* (2013.01); *Y10T 70/435* (2015.04); *Y10T 70/483* (2015.04); *Y10T 70/485* (2015.04); *Y10T 292/48* (2015.04); *Y10T 292/491* (2015.04); *Y10T 292/507* (2015.04); *Y10T 292/509* (2015.04)

(58) Field of Classification Search
CPC ..... E05B 83/14; E05B 67/003; E05C 19/08; G09F 3/0347; G09F 3/00; G09F 3/005; G09F 3/0291; G09F 3/0292; G09F 3/03; G09F 3/0376; G09F 3/0382; G09F 3/0388; G09F 3/0394; G09F 3/0352; G09F 3/0358; G09F 3/0364; G09F 3/037; B65D 27/12; B65D 27/20; B65D 27/22; B65D 27/24; B65D 27/26; B65D 27/28; B65D 27/30; Y10T 292/491; Y10T 292/48; Y10T 292/507; Y10T 292/509; Y10T 70/143; Y10T 70/435; Y10T 70/483; Y10T 70/485; Y10T 24/49–24/498
USPC ..... 292/307 A, 307 R, 315, 320, 321, 322; 70/20, 30, 49, 50
See application file for complete search history.

(56) References Cited

U.S. PATENT DOCUMENTS 3,402,435 A * 9/1968 Merser ..... B65D 63/1081 24/16 PB
3,466,077 A * 9/1969 Moberg ..... G09F 3/0352 24/16 PB
3,553,796 A * 1/1971 Carlile ..... A44B 17/0029 24/689
3,710,603 A * 1/1973 Miller ..... E05B 67/24 70/38 A
3,712,655 A * 1/1973 Fuehrer ..... F16B 21/071 24/16 PB
3,713,309 A * 1/1973 Miller ..... E05B 67/24 70/369
3,717,369 A * 2/1973 Stoffel ..... G09F 3/0358 292/321
3,854,482 A * 12/1974 Laugherty ..... A61B 17/122 24/543
3,881,759 A * 5/1975 Fuehrer ..... F16B 21/071 292/321
3,954,294 A * 5/1976 Iwamoto ..... B65D 63/1081 292/318
3,954,295 A * 5/1976 Harley ..... B65D 63/1081 24/16 PB
4,229,031 A * 10/1980 Guiler ..... G09F 3/0358 292/322
4,319,776 A * 3/1982 Moberg ..... G09F 3/0358 292/322
4,326,741 A * 4/1982 Wilson ..... G09F 3/037 292/307 R
4,441,233 A 4/1984 Swift
4,506,921 A 3/1985 Swift
4,532,679 A * 8/1985 Scott ..... B65D 63/1081 24/16 PB
4,588,218 A 5/1986 Guiler
4,640,538 A 2/1987 Brammall
4,681,355 A * 7/1987 Brammall ..... F16B 2/16 292/323
4,697,833 A 10/1987 Swift
4,826,027 A * 5/1989 Nilson ..... G09F 3/0317 116/200
5,056,837 A * 10/1991 Fuehrer ..... B65D 63/1081 292/307 R
5,116,091 A 5/1992 Swift
5,222,776 A 6/1993 Georgopoulos et al.
5,522,627 A 6/1996 Swift
5,524,945 A * 6/1996 Georgopoulos ..... G09F 3/037 24/16 PB
5,538,300 A 7/1996 Brown
5,791,170 A * 8/1998 Officer ..... E05B 67/003 70/14
5,820,176 A 10/1998 Leon et al.
5,832,752 A * 11/1998 Zeller ..... E05B 17/10 242/373
5,884,949 A * 3/1999 Leon ..... G09F 3/0317 292/307 R
5,960,652 A * 10/1999 Marmstad ..... E05B 73/0011 70/233
6,000,736 A * 12/1999 Leon ..... G09F 3/0352 24/909
6,343,819 B1 * 2/2002 Shiozaki ..... G09F 3/037 292/307 A
6,345,847 B1 2/2002 Dreisbach et al.
6,371,539 B1 * 4/2002 Olshausen ..... G09F 3/0317 292/307 R
6,390,519 B1 * 5/2002 Dreisbach ..... G09F 3/0364 242/388.1
6,494,508 B1 * 12/2002 Dreisbach ..... G09F 3/0352 292/307 A
6,540,273 B2 4/2003 Brammall et al.
6,578,886 B1 * 6/2003 Bystry ..... G09F 3/037 292/307 R
6,578,887 B1 * 6/2003 Kienzler ..... G09F 3/0347 292/307 R
6,869,113 B2 * 3/2005 Burt ..... G09F 3/0352 292/307 A
6,948,746 B2 9/2005 Brammall et al.
7,118,144 B2 * 10/2006 Anderson ..... E05B 39/02 292/282
7,243,963 B2 * 7/2007 De Lima Castro ... G09F 3/0352 292/307 R
7,472,933 B2 * 1/2009 Weedon ..... G09F 3/0358 292/307 A
8,001,660 B2 * 8/2011 Cai ..... F16G 11/14 24/115 H
8,186,731 B1 * 5/2012 Romero ..... G09F 3/0358 292/307 B
8,578,566 B2 * 11/2013 Jolly ..... F16G 11/106 24/136 A
9,175,501 B2 * 11/2015 Nazzari ..... E05B 15/00
9,453,555 B2 * 9/2016 Dingley ..... F16G 11/048
2003/0168868 A1 * 9/2003 Bierlein ..... B65D 33/14 292/307 A
2006/0049646 A1 * 3/2006 Lima Castro ..... G09F 3/0352 292/318
2006/0131895 A1 * 6/2006 Weedon ..... G09F 3/0358 292/316
2006/0196016 A1 * 9/2006 Cai ..... F16G 11/14 24/136 R
2007/0210085 A1 * 9/2007 Robinson ..... G09F 3/0364 220/214
2012/0133158 A1 * 5/2012 Zhang ..... B65D 63/1081 292/307 A
2015/0259951 A1 * 9/2015 Nazzari ..... G09F 3/0364 70/15

* cited by examiner

THERMOPLASTIC SECURITY SEAL WITH COVERED LOCKING RECESS

This invention claims priority on U.S. provisional application No. 61/978.303 filed Apr. 11, 2014 in the name of Chistopher Benning et al. incorporated by reference in its entirety herein and relates to thermoplastic molded security seals with improved manufacturing cost effectiveness.

Security seals have numerous sizes, shapes and elements that differ in many different ways from each other. Many such seals may be metal, plastic or combination of different materials. The present invention relates particularly to a molded thermoplastic security seal of the type having a locking chamber and a mating locking element which together form a locked close loop for securing a hasp and the like. The locking element or the locking chamber may include a resilient tang or locking member that mates by compressively bending the resilient tang or locking member during insertion into the locking chamber and which locking member returns to its quiescence position in the locked state.

Commonly owned U.S. Pat. No. 5,522,627 ('627) to Swift, incorporated by reference in its entirety herein, discloses a molded thermoplastic security seal similar to the type of seal according to the present invention. The prior art seal, however, is different and comprises a molded thermoplastic housing body to which a movable leg is attached that is resiliently rotatable including a molded spring at the hinge region of the leg-body interface and a second rigid non-movable leg also attached to the body and spaced from the movable leg. A socket is secured to the extended free end of the movable leg and having a locking cavity with internal flexible locking fingers. The free end of the rigid leg has a stud locking element that engages and locks to the locking cavity via internal flexible locking fingers in the socket chamber which resiliently flex to receive the locking stud element. The housing body from which the movable and rigid legs extend is solid. This seal is successful. But it also has problems.

This seal tends to be costly in that it requires multiple molds during its manufacturing process and subsequent assembly of the parts. These seals compete in competitive markets and, therefore, cost is critical. A need is seen to provide a similar seal at lower cost.

Seals similar to the '627 type of seal are disclosed in commonly owned U.S. Pat. Nos. 5,116,091; 4,506,921; 4,319,776; 4,441,233 and 4,588,218 among others.

The problem present with the prior art seals is recognized by the present inventors as lying in the process of molding such plastic seals. They recognize that such seals may be produced at lower cost if the number of molds can be reduced to a single mold.

Another problem is that such chambers need to be fully enclosed so that a tamperer does not have access to the locked locking element inside the locking chamber. The prior art as exemplified by the above patents approach this problem with specific designs of the locking arrangements of the seals. These arrangements tend to be costly to produce.

A need is seen for a lower cost mass produced thermoplastic seal of the type described above, and importantly, which, at the same time, provides effective evidence of tampering while solving the problem of molding the seal in an efficient mass produced manner. Evidence of tampering is also important in these types of seals.

A security seal according to an embodiment of the present invention comprises a housing body having a locking recess, the recess having an opening for receiving a mating seal locking element; the recess having a region normally exposed to the ambient atmosphere facing in a given direction from the body; a cover secured to the body over the locking recess for enclosing the recess; an arm extending from the body arranged so that at least a portion of the arm can move relative to the body; the locking element being attached to the arm for engaging the locking recess, the recess and the locking element being arranged to cooperatively lock the received element within the recess so that the locked arm and body forms a locked hasp receiving loop; and a cover locking arrangement for securing the cover to the body.

In a further embodiment, the body has a chamber overlying and in communication with the recess, the cover for being received in the chamber.

In a further embodiment, the cover and body are initially molded as one piece thermoplastic and the cover then separated from the body for attachment over the recess.

In a further embodiment, the chamber is circular and frusto-conical, the cover is a frusto-conical disc that closely mates with the chamber, the body and cover each having a chamfered rim mating with one another, encircling and enclosing the chamber.

In a further embodiment, the body is partially circular cylindrical and partially rectangular.

In a further embodiment, the body defines a plane, the body being of such small size so as to substantially preclude receiving bar code identification indicia, further including an extension member extending from the body, the arm extending from the extension member, the arm, body and extension member being coplanar, the extension member for receiving the bar code identification indicia.

In a further embodiment, the body defines a plane, further including an extension member extending from the body for receiving bar code Identification indicia, the arm extending from the extension member, further including a stanchion attached to the extension member, the arm extending from the stanchion and being movable relative to the stanchion, the arm, the body and extension member being coplanar.

In a further embodiment, the body includes an extension member extending from the body for receiving bar code Identification indicia, the arm extending from the extension member.

In a further embodiment, an extension member extends from the body for receiving bar code Identification indicia, the arm extending from the extension member, further including a stanchion attached to the extension member, the arm extending from the stanchion, and a hinge connecting the arm to the stanchion.

In a further embodiment, the cover is a disc having at least one post extending therefrom, the body having at least one bore arranged to receive the at least one post there through, the post having a portion extending beyond the body, and which portion is deformed to preclude withdrawal of the post and cover from the body, locking the cover to the body.

In a further embodiment, the cover is a circular disc having a chamfered rim and at least one post extending substantially normal to and from the cover, the body including a chamber for receiving the cover, the recess being located in communication with the chamber, the body having at least one bore in communication with the chamber arranged to receive the at least one post, and a locking arrangement for locking the cover to the body.

In a further embodiment, the cover is a circular disc having a chamfered rim, the body having a chamber for receiving the cover, the chamber having a chamfered rim for engaging the received disc chamfered rim, the locking recess being in communication with the chamber, and an arrangement for locking the cover to the body in the body chamber.

In a further embodiment, the cover is a fruto-conical disc having a chamfered rim and a plurality of posts extending from the cover, the body having a chamber in communication with the locking recess and having a plurality of bores arranged to receive respective ones of the posts, the posts and body being arranged for locking the posts and the cover to the body.

IN THE DRAWING

Figure 1:
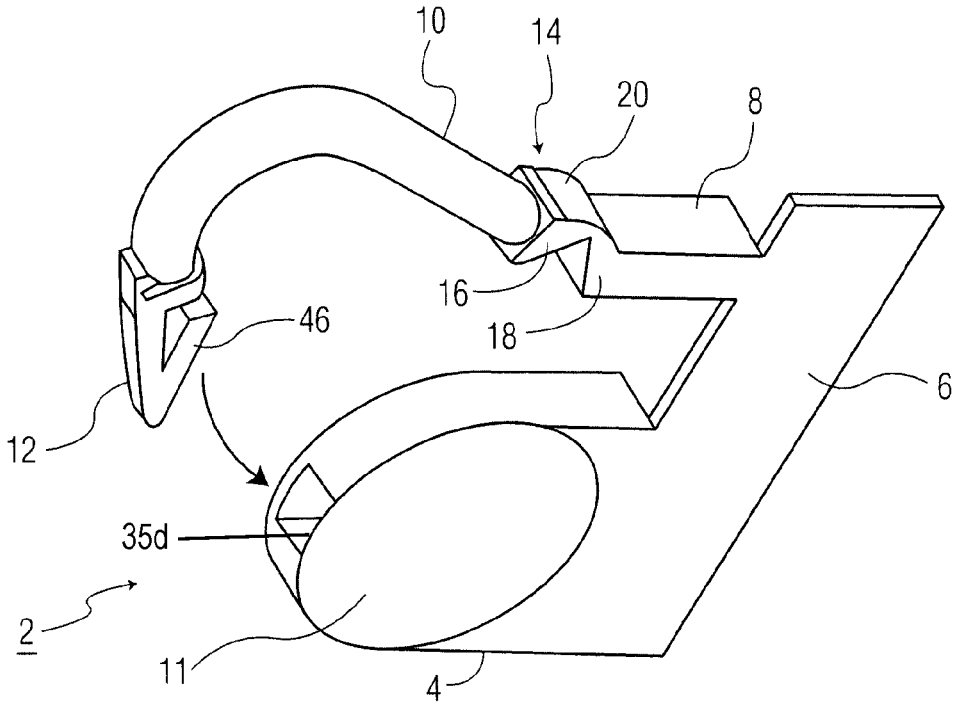
FIG. 1 is an isometric top view of a security seal with a locking recess enclosed by a cover in the seal unlocked state with a rotatable elongated arm having a locking element extending from its free end for locking engaging a mating element associated with the recess.

In FIG. 1, seal 2 according to one embodiment of the present invention, comprises a body 4, an extension 6, an upstanding stanchion 8, an arm 10, a cover 11 and a locking element 12. The arm 10 is movably secured to the stanchion 8 by a living hinge 14. A living hinge is plastic material that is made sufficiently thin so that it can flex at its narrowest location between two hinge portions. For example hinge 14 has portions 16 and 18 connected to a relatively thin section 20 that permits the portions 18 and 18 to move relative to one another.

Extension 6 is an elongated flat member of relatively thin cross section and preferably rectangular. The extension could be of any size or shape. However, the extension 6 is shaped and sized to receive bar code identification indicia or other indicia (not shown). The extension 6 is provided as the body 4 is only about 20 mm in in diameter in this embodiment and which is too small an area to receive the desired bar code or other desired indicia. Such other indicia may include imprinting the extension with the seal manufacturer name or other information as may be desired in a given implementation.

Figure 2:
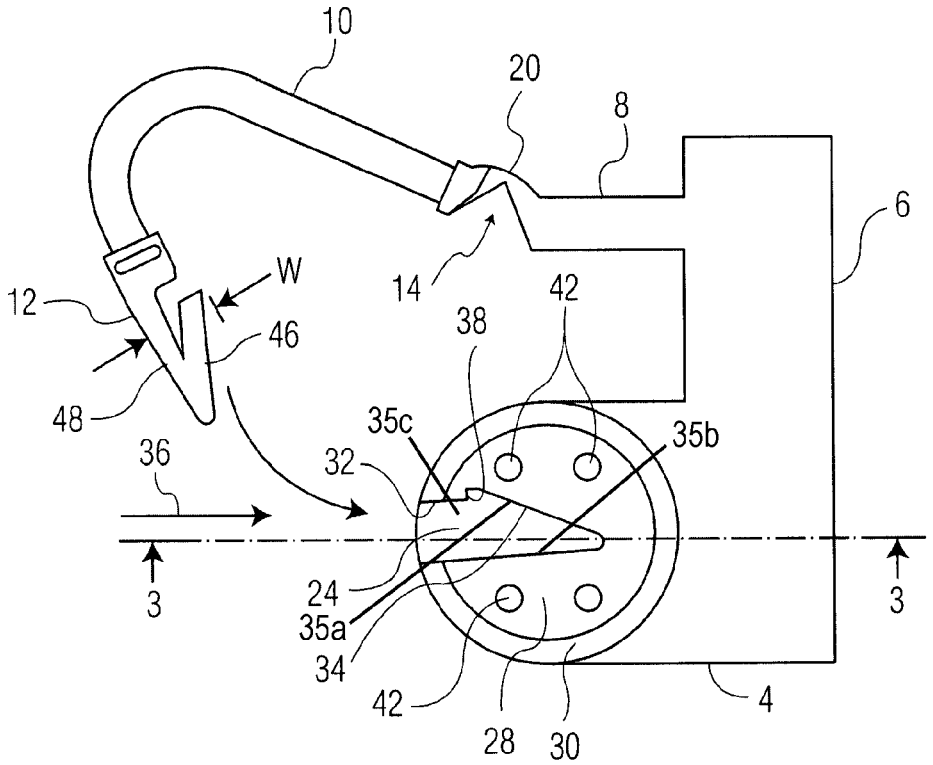
FIG. 2 is a top plan view of the seal of FIG. 1 without the recess cover in place in the unlocked state.
Figure 3:
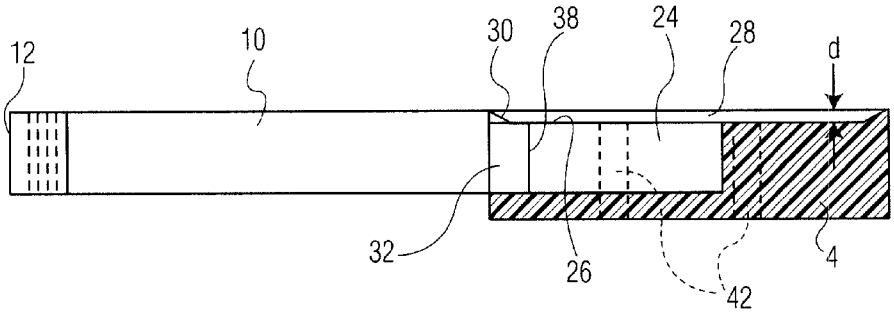
FIG. 3 is a cross sectional elevation view of the seal of FIG. 2 taken along lines 3-3 of FIG. 2.
Figure 4:
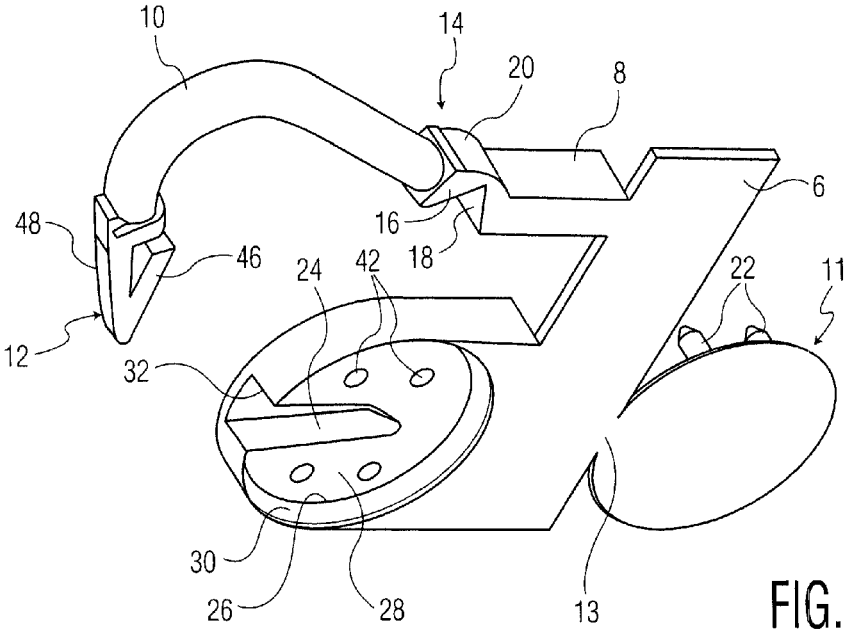
FIG. 4 is a an isometric top view of the seal similar to the view of FIG. 1 without the locking recess cover locked in place as in FIG. 1, but instead with the cover attached to the seal body and arm assembly in the as molded state as a one piece unit.

In FIG. 4, the cover 11 is molded simultaneously with and one piece with the body 4. The cover 11 has four molded upstanding like posts 22, FIG. 6, which could be different than shown if desired in shape and configuration (not shown). When the cover 11 is employed in the final seal configuration FIGS. 1, 9, for example, it is separated from the body 4 (FIG. 4) at junction 13 so the body 4 no longer has the cover 11 attached, but rather becomes a separate and independent piece from the body 4, FIGS. 8 and 9. In FIGS. 2, 3 and 4, the body 4 is molded with a locking recess 24 that is in communication with the bottom surface 26 of chamber 28.

Figure 5:
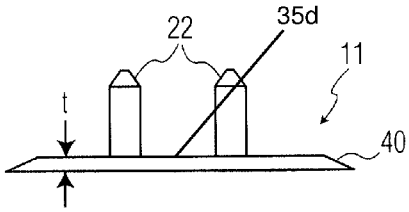
FIG. 5 is a side elevation view of the locking recess cover in the locked state for enclosing the locking recess.

Chamber 28 is shallow, having a depth d, FIG. 3, the same as the thickness t of the cover 11, FIG. 5. The chamber 28 closely receives the cover 11, FIGS. 8 and 9. The chamber 28 has a circular chamfered side wall 30 forming a frusto-conical chamber 28, that mates with the chamfered side wall 40 of the cover 11, FIG. 5. The chamfered side walls serve to guide the cover in place into the chamber 28 by a robot (not shown). The robot (not shown) also separates the cover 11 from the body 4 while they are still in the mold (not shown).

Figure 6:
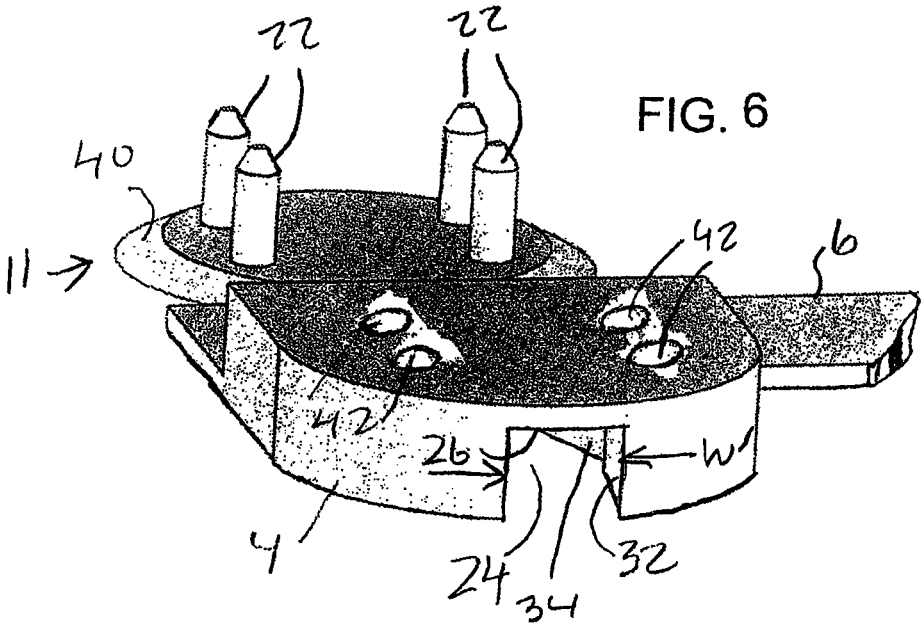
FIG. 6 is an isometric bottom view of the seal of FIG. 4 locking body and cover portion showing posts for locking the cover to the seal body for permanently enclosing the locking recess.
Figure 7:
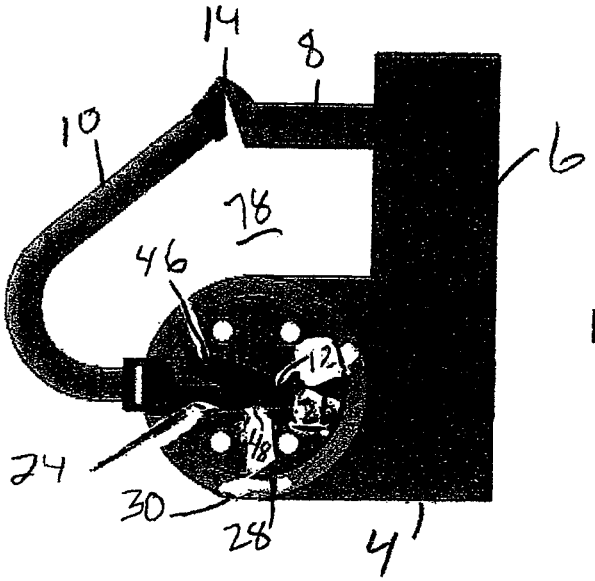
FIG. 7 is a top plan view of the seal of FIG. 1 without the cover in place in the seal locked state prior to the securing of the cover to the seal body.

The locking recess 24 has an egress opening 32, FIGS. 2, 4 and 6. The recess 24 is arrow shaped to match the shape of the locking element 12. Recess 24 has a side wall 34 tapered at an angle to the insertion direction 36 of the locking element 12, attached to the arm 10. The tapered side wall 34 terminates at locking shoulder 38 in the recess 24. Locking shoulder 38 captures the tang 46 of the locking element 12, FIGS. 4 and 7, to lock the element 12 in the recess 24. Thus, as show in FIG. 2, the recess 24 in the body 4 provides first, second, and third interior wall surfaces at reference numbers 35*a*, 35*b*, and 35*c*, respectively, where the illustrated locking shoulder 38 is disposed at and divides portions of the first interior wall surface 35*a*. Further, as shown in FIGS. 1 and 5, the cover 11 is mated with the chamfered side wall 30 of the body 4 to provide a fourth interior wall surface 35*d* of the locking recess 24.

The body 4 has four identical through bores 42, as best seen in FIGS. 2 and 6. The bores 42 are formed in surface 26 and pass entirely through the body 4 in communication with the chamber 28. The bores 22 closely receive the respective posts 22, FIG. 6.

Figure 8:
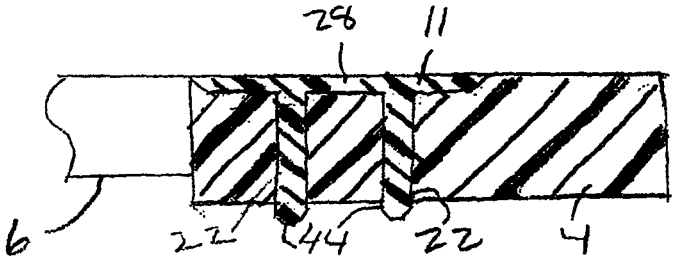
FIG. 8 is a partial sectional elevation view of the seal of FIG. 1 taken through two of the bores and inserted posts attached to the cover.
Figure 9:
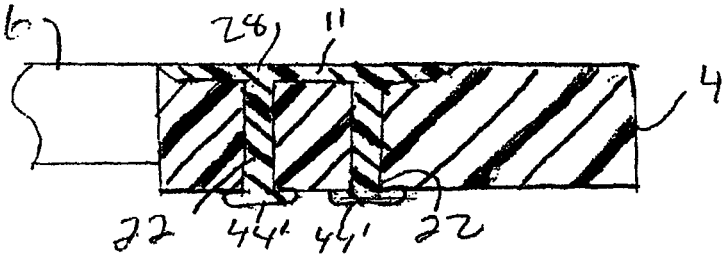
FIG. 9 is a sectional view similar to that of FIG. 8 but with the protruding post portions crushed and deformed to lock the cover to the seal body in the final form of the seal.
Figure 10:
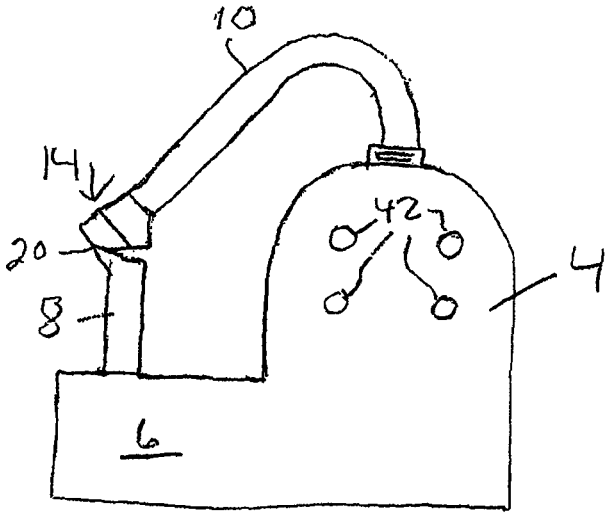
FIG. 10 is a bottom plan view of the seal of FIG. 7.

In FIGS. 8 and 9, the cover 11 is located in the chamber 28 and closely received therein with the chamfered sides mating as shown. The posts 22 are in the bores 42 and have a portion 44 that protrudes from the bores and the body 4 on the body side opposite the chamber 28. In FIG. 9, the portions 44 are deformed forming crushed portions 44'. The mold (not shown) is arranged to crush the post portions 44 after the robot (not shown) detaches the cover 11 from the body and inserts the cover into the mating chamber 28 and the posts 22 into the mating bores 42 in a manner not shown. This procedure saves the use of an additional mold to form the seal as in the prior art seals. The chamfered sides of the cover 11 and the chamber 28 serve to guide the insertion of the cover 11 into the chamber 28 by a robot (not shown).

In FIG. 1, the locking element 12 is arrow shaped with a resilient tang 46, The resilient tang 46 forms an arrow with a rigid tang 48. The width w of the two tangs, FIG. 2, is larger than the corresponding width w' of the opening 32, FIG. 6, to the recess 24. This results in the compression of the tang 46 toward tang 48 as the element 12 is inserted into the opening 32. Once inserted, the tang 44 inside the recess 24 returns to its quiescent state, FIG. 7. The shoulder 38 formed by the body at the recess opening 32 engages the inserted tang 46 precluding it from being withdrawn from the recess, locking the arm free end, locking element 12, to the body 4. The locked locking element and arm 10 thus forms a closed locked loop 78, FIG. 7, with the extension 6, stanchion 8, and body 4 for securing a hasp, for example.

Figure 11:
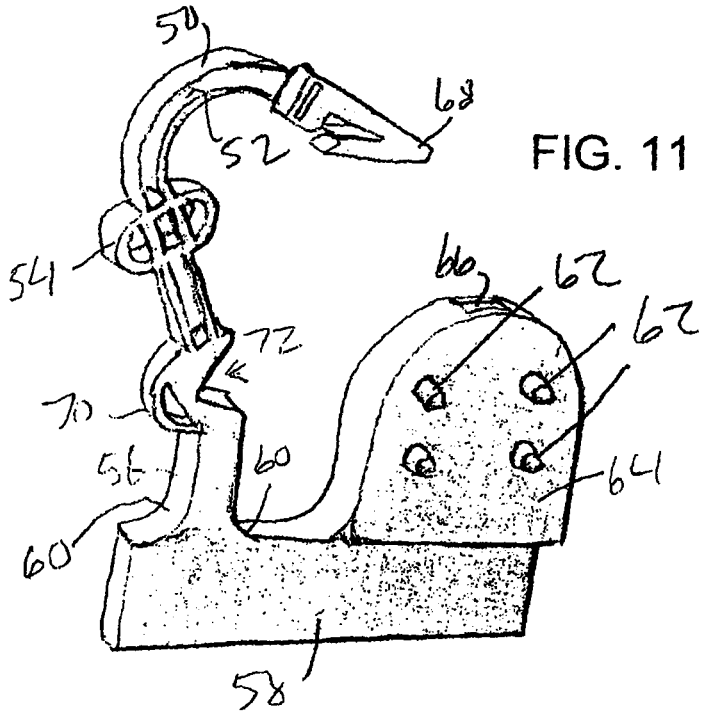
FIG. 11 is an isometric side view of a seal according to a further embodiment of the present invention with the cover attached to the body over the locking recess, but not secured locked to the body.
Figure 12:
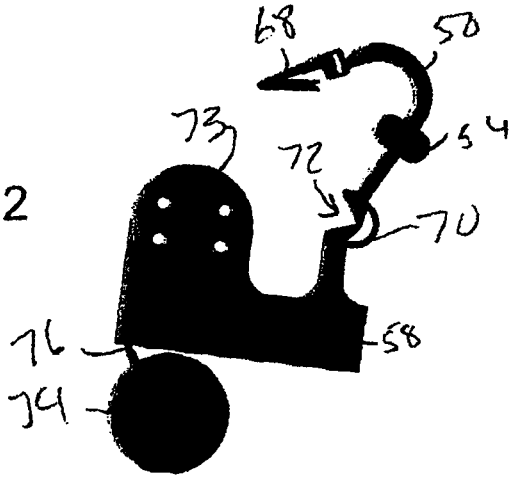
FIG. 12 is a top plan view of the seal of FIG. 11 in the one piece as molded state prior to the separation of the cover from the body.

FIGS. 11 and 12 show an alternate embodiment of a seal according to the present invention. In FIG. 11 the arm 50 has a channel 52 to reduce the amount of material used to make the seal. The arm 50 also has an oval transverse member 54, also with a channel therein, at the arm midsection. The stanchion 56 is secured to extension 58 with an enlarged reinforcing filet 60 having a relatively large radius. Posts 62 attached to the cover (not shown in this figure) protrude from the seal body bottom region 64 (FIG. 8). The locking recess (not shown) has an egress opening 66. Locking element 68 is arrow shaped as described above. A spring member 70 is attached over the hinge 72. This is shown in the prior art '627 patent. This member provides tamper evidence as once severed, it can not be restored to its original resiliency. The disc shaped cover 74 in this embodiment is attached to the seal body 73 by a narrow in cross section elongated member 76 to provide ease of separation of the cover 74 from the body 73.

It will occur to those of ordinary skill that modifications may be made to the disclosed embodiments. For example, the disclosed body, locking arm and locking element, the configuration and orientation of the various disclosed elements, their materials, dimensions, and overall configurations may differ from those disclosed herein. For example, the cover could be welded to the body at its rim and the posts omitted. However, this embodiment would not be as desirable, as the welds might be tampered with and glued in place later in an undetectable manner. The deformed posts, however, provide improved tampering evidence as any tampering therewith would destroy the deformed region making it readily observable as being tampered with. The preferred embodiment disclosed herein is given by way of illustration and not limitation. Such modifications are intended to be included in the scope of the present invention as defined by the appended claims.

What is claimed is:

1. A security seal comprising:

a body having a locking recess extending inward from a first side surface of said body for receiving a locking element in an insertion direction, wherein said body includes (i) a first interior wall surface of said locking recess, (ii) a second interior wall surface of said locking recess, and (iii) a third interior wall surface of said locking recess;

a cover secured to a second side surface of said body and extending over a portion of said locking recess, wherein said first side surface is generally perpendicular to said second side surface, and wherein said cover includes an interior surface providing a fourth interior wall surface of said locking recess, and wherein said first, second, third, and fourth interior wall surfaces surround said locking recess and are generally parallel with said insertion direction, and wherein a locking feature is disposed at one of said first, second, and third interior wall surfaces of said locking recess for engaging said locking element when said locking element is inserted into said locking recess;

wherein said body includes a chamber recess extending inward from said second side surface and in communication with said locking recess, and wherein said cover is received in said chamber recess such that said interior surface of said cover engages a bottom surface of said chamber recess and an exterior surface of said cover is generally co-planar with a non-recessed area of said second side surface;

at least two attachment features protruding from said interior surface of said cover and engaging within bores that extend through said bottom surface of said chamber recess separate from and on opposing sides of said locking recess;

an arm extending from said body and having a living hinge between a movable portion of said arm and said body, wherein said movable portion of said arm is configured to move relative to said body; and wherein said locking element is disposed at said movable portion of said arm for being inserted into said locking recess and engaging said locking feature, thereby forming a locked hasp receiving loop.

2. The security seal of claim 1, wherein said locking feature comprises a shoulder integrally formed by said body at one of said first, second, and third interior wall surfaces surrounding said locking recess, and wherein, when said locking element is inserted into said locking recess, said locking element engages said shoulder for precluding said locking element from being withdrawn from said locking recess.

3. The security seal of claim 1, wherein said cover and said body are initially molded as a single thermoplastic piece and, before attaching said cover to said body, said cover is completely separated from said body for attachment over said locking recess.

4. The security seal of claim 1, wherein said chamber recess is circular and frusto-conical, and wherein said cover comprises a frusto-conical disc that mates with said chamber recess, and wherein said body and said cover each having a chamfered rim mating with one another, encircling and enclosing said chamber recess.

5. The security seal of claim 1, wherein said body comprises a cylindrical shape, and wherein said insertion direction extending through a circumferential surface of said cylindrical shape.

6. The security seal of claim 1, wherein an extension member extends from said body for receiving a bar code indicia, and wherein said arm extends from said extension member.

7. The security seal of claim 1, wherein said arm includes a stanchion fixed relative to said body, and wherein said movable portion of said arm extends from said stanchion and is movable relative to said stanchion.

8. The security seal of claim 1, wherein said body includes an extension member extending from said body for receiving bar code Identification indicia, and wherein said arm extends from said extension member.

9. The security seal of claim 1, including an extension member extending from said body for receiving bar code Identification indicia, and wherein a stanchion extends from said extension member, and wherein said movable portion of said arm extends from said stanchion, and wherein said living hinge is disposed between said movable portion of said arm and said stanchion.

10. The security seal of claim 1, wherein said cover comprises a disc, wherein said at least two attachment features each comprise at least one post extending from an interior surface of said disc, and wherein said bores are arranged to receive said at least one post there through, and wherein said at least one post includes a distal portion that is configured to extend beyond said body, and wherein said distal portion is configured to be deformed to prevent withdrawal of said at least one post and said cover from said body.

11. The security seal of claim 1, wherein said cover comprises a circular disc having a chamfered rim and, wherein said at least two attachment features each comprise at least one post extending substantially normal from an interior surface of said cover, and wherein said body includes at least one bore thorough said body in communication with said chamber recess and arranged to receive said at least one post.

12. The security seal of claim 1, wherein said cover comprises a circular disc having a chamfered rim, and wherein said body includes a chamfered rim around said chamber recess for engaging said chamfered rim of said circular disc.

13. The security seal of claim 1, wherein said cover comprises a frusto-conical disc having a chamfered rim, wherein said attachment features comprise a plurality of posts extending from a planar surface of said frusto-conical disc, wherein said body includes a plurality of bores extending through said second side surface and arranged to receive respective ones of said plurality of posts, and wherein said posts and body being arranged for locking said posts and said cover to said body.

14. A security seal comprising:

a body having (i) a locking recess extending inward from a first side surface of said body and (ii) a chamber recess extending inward form a second side surface of said body and in communication with said locking recess, wherein said first side surface of said body is generally perpendicular to said second side surface of said body;

an arm extending from said body and having a movable portion that is configured to move relative to said body;

a locking element disposed at said movable portion of said arm, wherein said locking element is configured to be inserted in an insertion direction into said locking recess to engage a locking feature on said body that is disposed at an interior surface within said locking recess, and wherein, when said locking element is engaged with said locking feature, said arm and said body form a locked loop;

a cover configured to attach at said second side surface of said body and, when attached at said second side surface of said body, said cover is disposed over a portion of said locking recess, wherein said cover includes an interior surface that, when attached at said body, defines an interior side wall surface of said locking recess in generally parallel alignment with said insertion direction, and wherein, when said cover is attached at said second side surface of said body, said cover is received in said chamber recess such that said interior surface of said cover engages a bottom surface of said chamber recess and an exterior surface of said cover generally aligns with a non-recessed area of said second side surface; and at least two posts protrude from said interior surface of said cover and engage within bores that extend through said bottom surface of said chamber recess separate from and on opposing sides of said locking recess.

15. The security seal of claim 14, wherein said interior surface of said cover is configured to be received in a recessed area of said second side surface of said body, and wherein, when said cover is attached at said second side surface of said body, said exterior surface of said cover is generally co-planar with said non-recessed area of said second side surface.

16. The security seal of claim 14, wherein said posts are configured to be inserted in a lateral direction generally orthogonal to said insertion direction into said bores that extend inward from said second side surface of said body to secure said cover to said body.

17. The security seal of claim 14, wherein said cover is formed with said body as a single thermoplastic piece.

18. The security seal of claim 14, wherein said first surface includes a curved shape.

19. The security seal of claim 14, wherein said arm includes a living hinge between said movable portion of said arm and said body that is configured for said movable portion to move about said living hinge.

20. The security seal of claim 14, wherein said locking feature comprises a shoulder formed by said body at said interior surface within said locking recess, and wherein, when said locking element is inserted into said locking recess, said locking element engages said shoulder for precluding said locking element from being withdrawn from said locking recess.

* * * * *